US007950083B2

(12) United States Patent
Flannery

(10) Patent No.: US 7,950,083 B2
(45) **Date of Patent: *May 31, 2011**

(54) PORTABLE CHILD BED

(75) Inventor: Mark A. Flannery, Longboat Key, FL (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/776,405

(22) Filed: May 9, 2010

(65) Prior Publication Data

US 2010/0223723 A1 Sep. 9, 2010

Related U.S. Application Data

(62) Division of application No. 11/606,490, filed on Nov. 30, 2006, now Pat. No. 7,712,163.

(51) Int. Cl.

| | |
|---|---|
| *A47C 17/64* | (2006.01) |
| *A47C 17/00* | (2006.01) |
| *A47C 19/00* | (2006.01) |
| *A47C 17/70* | (2006.01) |

(52) U.S. Cl. ..... 5/114; 5/110; 5/112; 5/115; 5/116

(58) Field of Classification Search ..... 5/110, 111, 5/112, 114, 115, 116

See application file for complete search history.

(56) References Cited

U.S. PATENT DOCUMENTS

| | | | |
|---|---|---|---|
| 870,058 | A | 11/1907 | Sparmaker |
| 998,761 | A | 7/1911 | Engstrand |
| 3,049,724 | A | 8/1962 | Goodman |
| 3,169,544 | A | 2/1965 | Brown |
| 3,565,040 | A | 2/1971 | Pohl |
| 3,693,641 | A | 9/1972 | Moss |
| 5,072,694 | A | 12/1991 | Haynes et al. |
| 5,146,634 | A | 9/1992 | Hunt |
| 5,197,411 | A | 3/1993 | Schwarzenbart |
| 6,122,781 | A | 9/2000 | Stephenson |
| 6,564,402 | B1 | 5/2003 | Lin |
| 6,591,778 | B1 | 7/2003 | Alderman |
| 2006/0219181 | A1 | 10/2006 | Pape et al. |
| 2008/0127897 | A1 | 6/2008 | Flannery |

*Primary Examiner* — Jonathan J Liu

(57) ABSTRACT

A portable child bed in the nature of a cot. The cot includes a frame having a network of interconnected legs such that the frame is collapsible and expandable between open and closed configurations. The frame includes a stop to halt the expansion of the frame at a certain position. Flexible bedding depends from the frame in the nature of a hammock, with the flexible bedding being anchored at six positions about the frame. The frame of interconnected legs includes legs that are shaped to be out-of-the-way of the depending flexible bedding such that a child rests on the flexible bedding, not on the frame. Flexible straps run on an underside of the bedding and run to and between hubs of the frame.

7 Claims, 5 Drawing Sheets

PORTABLE CHILD BED

This application is a division of U.S. patent application Ser. No. 11/606,490 filed Nov. 30, 2006, now U.S. Pat. No. 7,712,163 issued May 11, 2010, and claims the benefit thereof under 35 U.S.C. §120, which application is hereby incorporated by reference.

FIELD OF THE INVENTION

The present invention relates generally to a portable child bed, particularly to a portable child bed in the nature of a cot, and specifically to a cot having a frame of interconnected legs and hubs, where the frame may be expanded and collapsed between open and closed configurations along with flexible bedding anchored to the frame where the bedding folds out and folds in when the frame is expanded and collapsed.

BACKGROUND OF THE INVENTION

"The bigger you are, the harder you fall" is an adage that unfortunately applies to children too. Such is a problem when the sleeping surface of the prior art cot is too high.

A high center of gravity is another problem. A prior art cot tends to flip when a child rolls to the edge or when a child sits on the edge or end.

A set of legs extending straight up and down is another drawback of the prior art cot. Such legs tend to be independent of the other legs. This kind of construction provides an inherent weakness to the structure of the prior art cot. Further, independent acting legs may act just like a wobbling table in a restaurant. The uneven surface on which the prior art cot stands is magnified.

The choice of fabric for the sleeping surface of the prior art cot has been overlooked. The fabric is often chosen for its aesthetics, not for its strength. Moreover, the fabric is engaged to the frame in a pretty way, not in a way to complement the underlying mechanical frame and add strength to the cot as a whole.

SUMMARY OF THE INVENTION

A feature of the present invention is the provision in a portable child bed having a frame that is collapsible from an open configuration to a closed configuration and expandable from the closed configuration to the open configuration, of at least six upper hubs and at least six lower hubs, with the upper hubs lying generally in a first plane in each of the open and closed configurations, and with the lower hubs lying generally in a second plane in each of the open and closed configurations, with the upper hubs confronting each other when the portable child bed is in the closed position, with the lower hubs confronting each other when the portable child bed is in the closed position, with each of the upper hubs being paired with and confronting one of the lower hubs when the portable child bed is in the open position, with each of the lower hubs having a face for confronting a surface on which the portable child bed rests.

Another feature of the present invention is the provision in a portable child bed having a frame that is collapsible from an open configuration to a closed configuration and expandable from the closed configuration to the open configuration, of at least twelve interlocking legs, with each of the interlocking legs having an upper end section, a midsection and a lower end section, with each of the interlocking legs being pivotally joined to another interlocking leg at the midsection via a first pivot, with each of the upper end sections of the interlocking legs being pivotally joined to one of the upper hubs, and with each of the lower end sections of the interlocking legs being pivotally joined to one of the lower hubs such that the frame is collapsible from an open configuration to a closed configuration and expandable from the closed configuration to the open configuration.

Another feature of the present invention is the provision in a portable child bed having a frame that is collapsible from an open configuration to a closed configuration and expandable from the closed configuration to the open configuration, of flexible bedding engaged to each of the upper hubs and capable of receiving and supporting a small child when the child is sitting or lying down when the frame is in the open configuration, with the flexible bedding folding closed when the frame is collapsed from the open configuration to the closed configuration, and with the flexible bedding folding open when the frame is expandable from the closed configuration to the open configuration.

Another feature of the present invention is the provision in a portable child bed having a frame that is collapsible from an open configuration to a closed configuration and expandable from the closed configuration to the open configuration, of two additional interlocking legs being paired with each other, with the two additional interlocking legs being spaced from the first and second sides of the frame, with the two additional interlocking legs extending to and between the third and fourth sides of the frame, and with the two additional interlocking legs being engaged to four hubs of the third and fourth sides of the frame.

Another feature of the present invention is the provision in a portable child bed having a frame that is collapsible from an open configuration to a closed configuration and expandable from the closed configuration to the open configuration, of two additional interlocking legs being paired with each other, with the two additional interlocking legs extending to and between the third and fourth sides of the frame, with each of the two additional interlocking legs including an upper half-section disposed between the upper end section and the midsection of the interlocking leg, and with the upper half-section having a depression formed therein to make space above the upper half-sections for the flexible bedding to depend freely under a weight of a child from the hubs without making contact with the upper half-sections.

Another feature of the present invention is the provision in a portable child bed having a frame that is collapsible from an open configuration to a closed configuration and expandable from the closed configuration to the open configuration, of a first stop disposed between interlocking legs of a first pair of said interlocking legs, with the first stop automatically engaging one said interlocking leg when the frame is in said open configuration and preventing the frame from further opening, and with the first stop automatically disengaging the one interlocking leg when the frame is collapsed from the open configuration.

Another feature of the present invention is the provision in a portable child bed having a frame that is collapsible from an open configuration to a closed configuration and expandable from the closed configuration to the open configuration, of the flexible bedding having sheeting extending from the first side of the frame to the second side of the frame and from the third side of the frame to the fourth side of the frame, and wherein the flexible bedding further comprises flexible straps engaged to the sheeting and running underneath the sheeting, with each of the straps running to and between two hubs.

Another feature of the present invention is the provision in a portable child bed having a frame that is collapsible from an open configuration to a closed configuration and expandable from the closed configuration to the open configuration, of the flexible straps extending obliquely from the third side of the frame to the fourth side of the frame and engaging another flexible strap that also extends obliquely from the third side of the frame to the fourth side of the frame.

Another feature of the present invention is the provision in a portable child bed having a frame that is collapsible from an open configuration to a closed configuration and expandable from the closed configuration to the open configuration, of one of the flexible straps being spaced from each of the first and second sides of the frame and extending generally perpendicularly from the third side of the frame to the fourth side of the frame, of another of the flexible straps extending along the third side of the frame, of another of the flexible straps extending along the fourth side of the frame, and with the flexible strap that is spaced from the first and second sides of the frame engaging at hubs the flexible straps that extend along the third and fourth sides of the frame.

Another feature of the present invention is the provision in a portable child bed having a frame that is collapsible from an open configuration to a closed configuration and expandable from the closed configuration to the open configuration, of one of the flexible straps extending along the first side of the frame, of another of the flexible straps extending along the third side of the frame, and with the flexible straps engaging each other at one of the upper hubs.

Another feature of the present invention is the provision in a portable child bed having a frame that is collapsible from an open configuration to a closed configuration and expandable from the closed configuration to the open configuration, of one of the hubs on the third side of the frame including at least five of the flexible straps radiating therefrom, with two of the five flexible straps radiating obliquely of the hub relative to the third side of the frame, with two of the five flexible straps radiating generally parallel to the hub relative to the third side of the frame, and with one of the five flexible straps radiating generally perpendicular to the hub relative to the third side of the frame.

Another feature of the present invention is the provision in a portable child bed having a frame that is collapsible from an open configuration to a closed configuration and expandable from the closed configuration to the open configuration, of the flexible bedding being free of direct connection to the interlocking legs and instead being directly connected to the upper hubs, and of the interlocking legs being free from the flexible bedding when the flexible bedding depends downwardly under the weight of a child.

An advantage of the present invention is a low sleeping surface. One feature contributing to this advantage is the network of interlocking legs.

Another advantage of the present invention is a low center of gravity. One feature contributing to this advantage is the set of interlocking legs that provides a low height to the sleeping surface. Another feature contributing to this advantage is the engagement of the flexible bedding in a hammock style arrangement.

Another advantage of the present invention is a sturdy cot that is relatively independent from the surface upon which it stands. The set of interlocking legs compensates for an uneven surface, such as where a rug meets a hardwood floor or such as the dirt or turf under the floor of a tent.

Another advantage of the present invention is that the sleeping surface itself provides strength to the frame of interlocking legs and to the present cot as a whole. One feature contributing to this advantage is that the sheeting of the flexible bedding is relatively strong in and of itself and is engaged to the upper hubs of the frame. Another feature contributing to this advantage is that the straps of the flexible bedding run to and from upper hubs of the frame and are also engaged to the upper hubs of the frame.

DESCRIPTION

Figure 1:
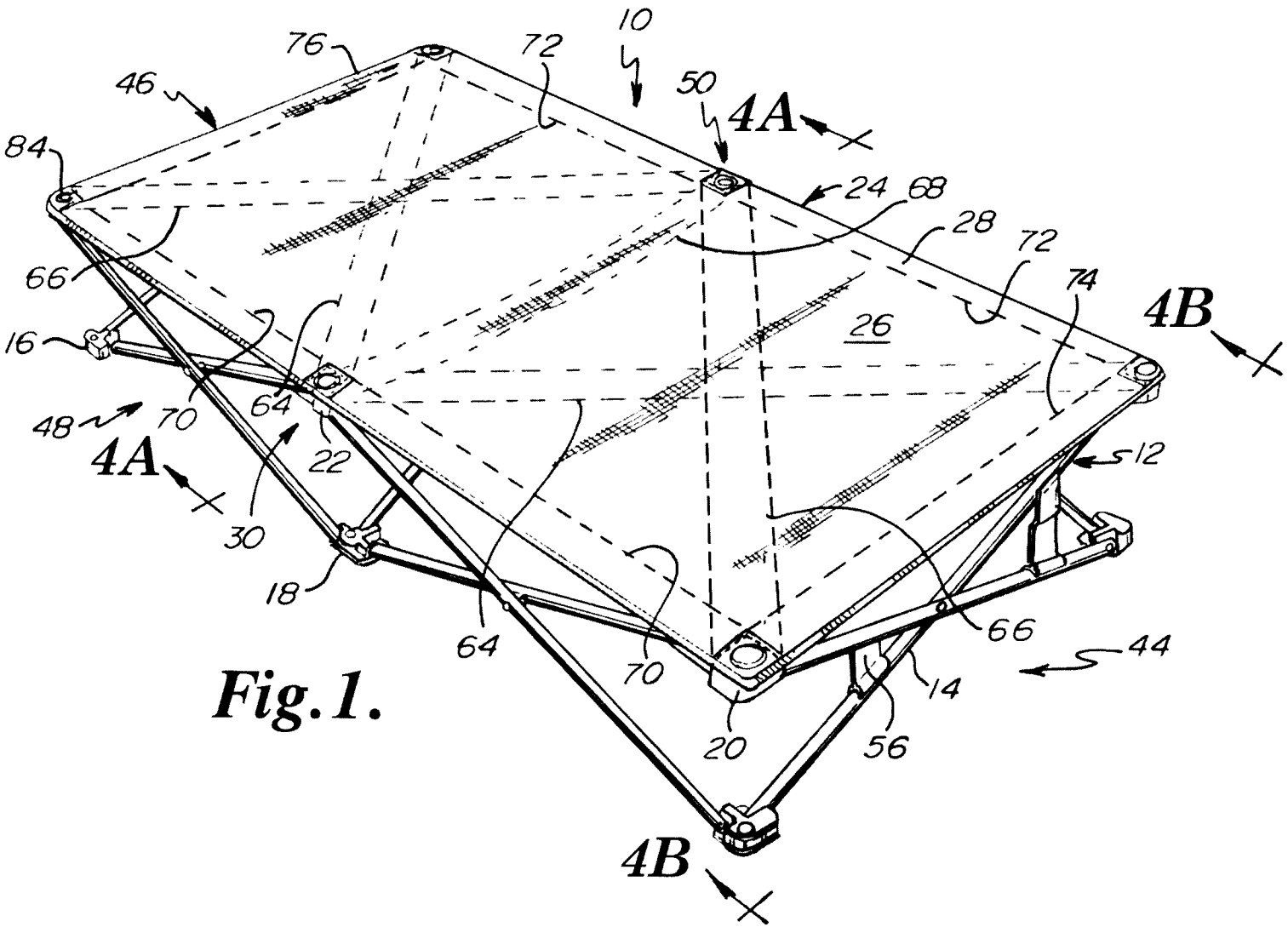
FIG. 1 is a perspective view of the present portable child bed in an open configuration.

As shown in FIG. 1, the present portable child bed or cot is indicated by reference numeral 10. The bed 10 includes a frame or network 12 of interconnected legs 14, and a set of hubs having lower corner hubs 16, lower middle hubs 18, upper corner hubs 20 and upper middle hubs 22. The bed 10 further includes flexible bedding 24 which includes sheeting 26 and strapping 28.

Figures 5A, 5B, 5C, 5D:
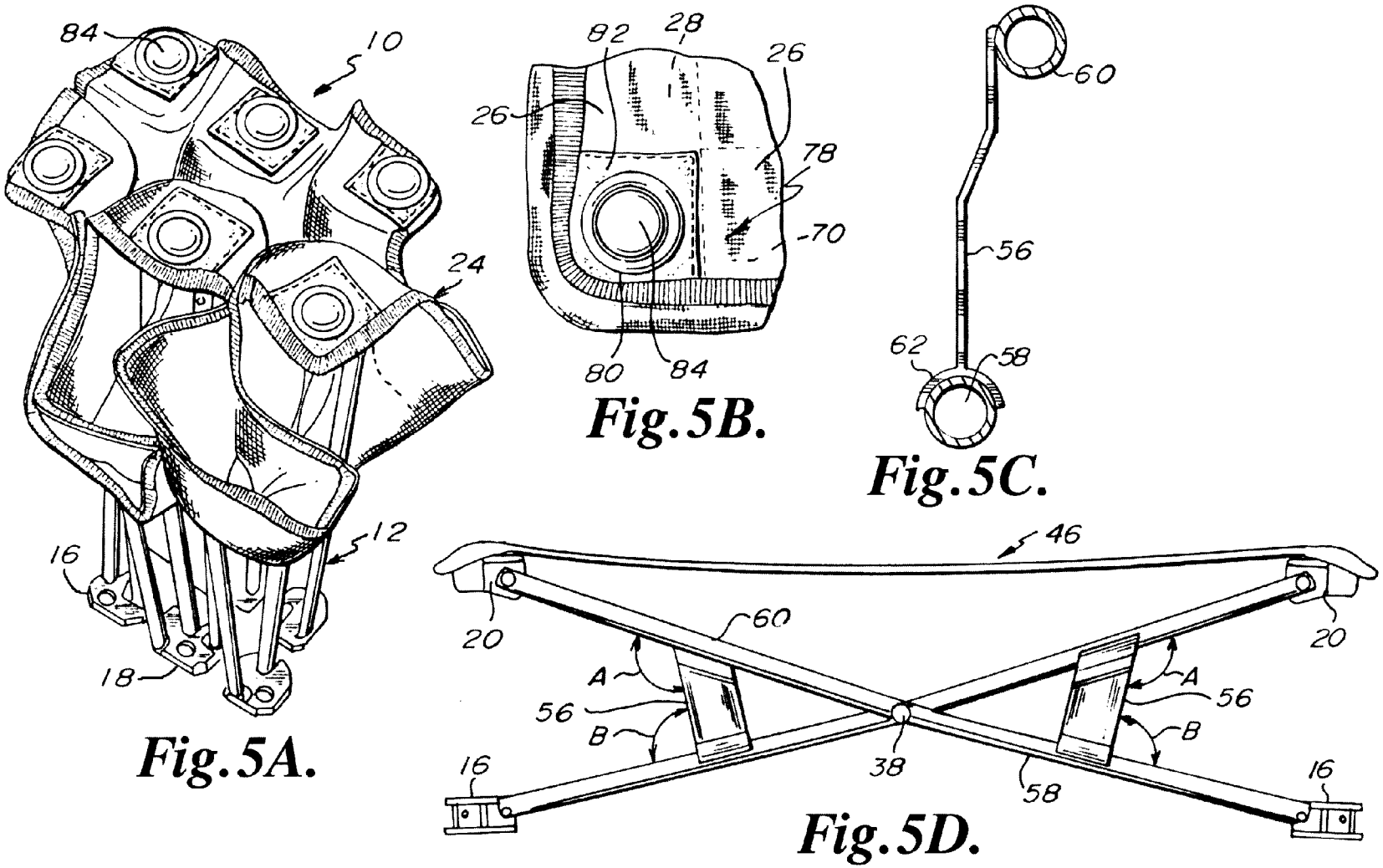
FIG. 5A is a perspective view of the portable child bed of FIG. 1 in a closed configuration.
FIG. 5B shows a reinforced opening where the flexible bedding of the bed of FIG. 1 engages the frame of the bed of FIG. 1.
FIG. 5C is a side view of the stop shown in FIGS. 4B and 5D with the legs of the frame taken in section.
FIG. 5D is an end view of the other of the end sets of interlocking legs of the portable child bed of FIG. 1 and shows the other two of the stops of the bed that prevent the frame from further expansion.

The frame 12 of the bed 10 is collapsible from the open configuration shown in FIG. 1 to the closed configuration shown in FIG. 5A, and is expandable from the closed configuration of FIG. 5A to the open configuration of FIG. 1 via the interconnected legs 14 and the hubs 16, 18, 20 and 22. The flexible bedding 24 folds closed when the frame 12 is collapsed from the open configuration to said closed configuration, and the flexible bedding 24 folds open when the frame 12 is expanded from the closed configuration to the open configuration.

Figure 2:
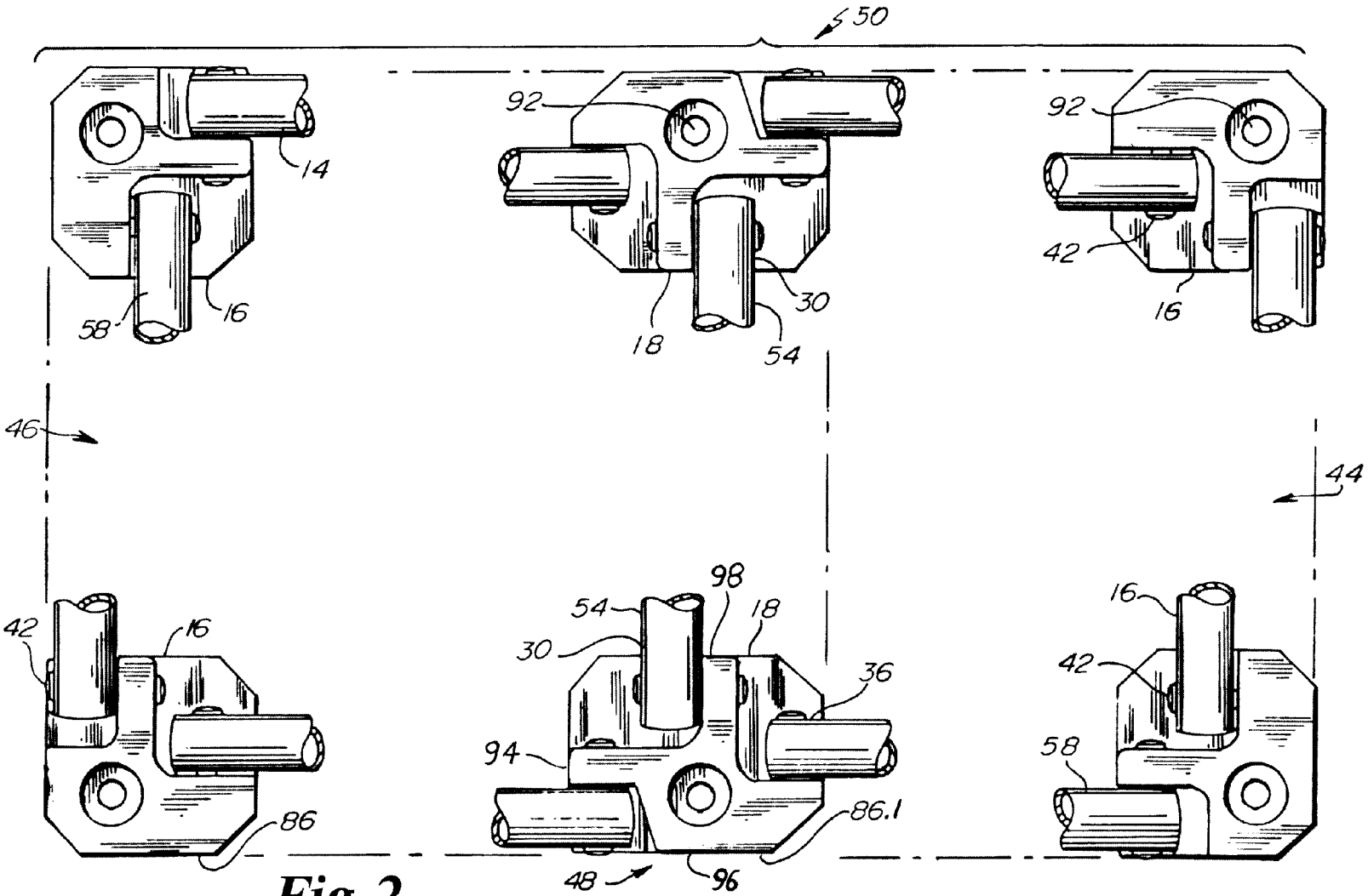
FIG. 2 is a top broken apart view of the set of lower hubs of the portable child bed of FIG. 1.
Figure 3:
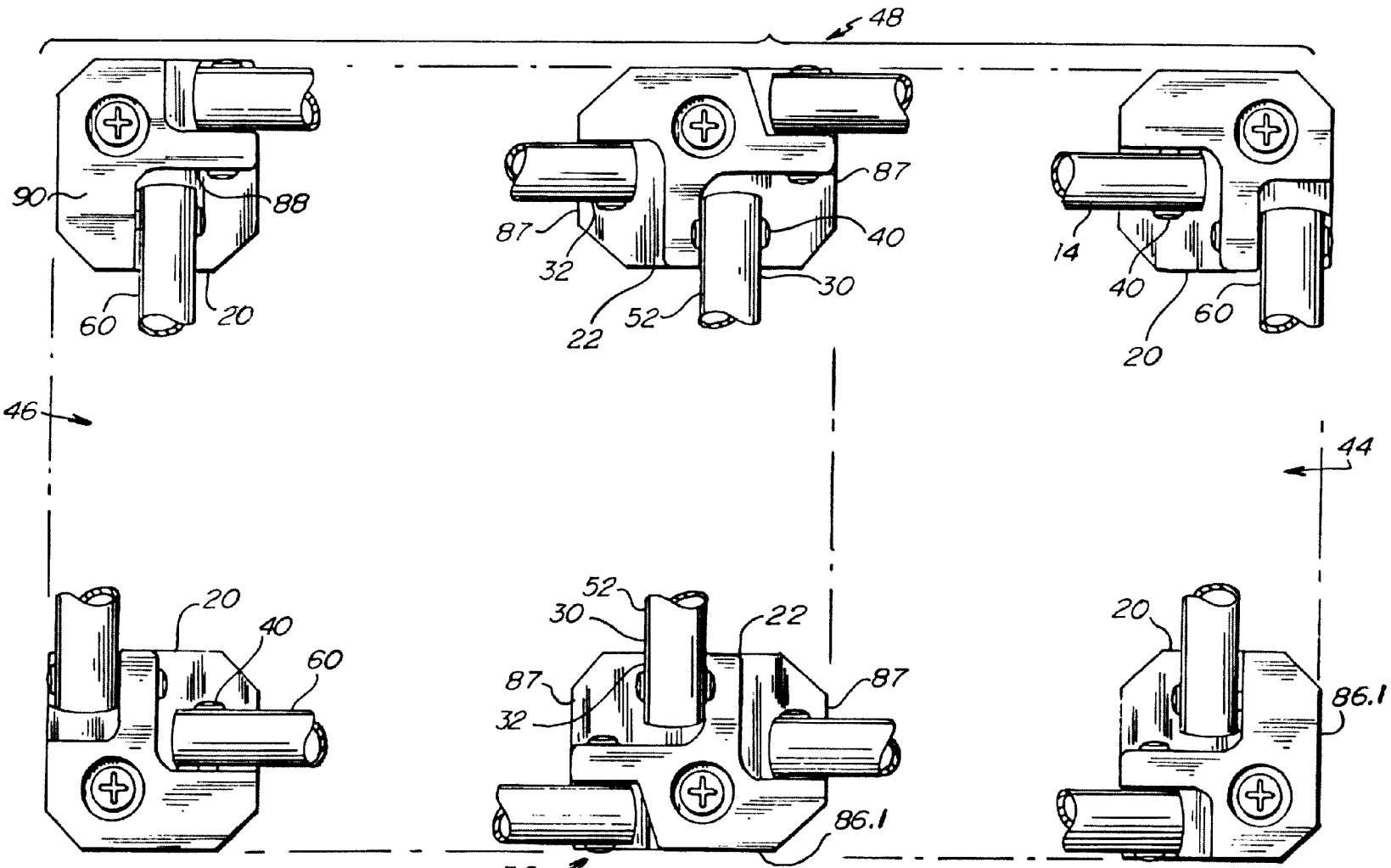
FIG. 3 is a bottom broken apart view of the set of upper hubs of the portable child bed of FIG. 1.

As indicated above and as shown in FIGS. 1, 2, 3 and 5A, the frame 12 includes lower corner hubs 16, lower middle hubs 18, upper corner hubs 20 and upper middle hubs 22. These hubs are shown in FIGS. 2 and 3 as well as in other Figures. The frame 12 includes at least six upper hubs 20 and 22 and at least six lower hubs 16 and 18. The upper hubs 20 and 22 lie generally in a first plane in each of the open and closed configurations. The lower hubs 16 and 18 lie generally in a second plane in each of the open and closed configurations. The upper hubs 20 and 22 confront each other when the portable child bed 10 is in the closed position. The lower hubs 16 and 81 confront each other when the portable child bed 10 is in the closed position. The upper hubs 20 and 22 are paired with and confront one of the lower hubs 16 and 18 when the portable child bed 10 is in the open position. The lower hubs 16 and 18 have a face for confronting a surface on which the portable child bed 10 rests, and such a face is preferably roughened or textured so as to be relatively nonslip when on a flat slick floor such as a hardwood floor.

The frame 12 includes least twelve interlocking legs 14, and preferably includes at least fourteen interlocking legs 14, with the additional two and optional interlocking legs being the interior pair 30 of interlocking legs 14. Each of the interlocking legs 14 includes an upper end section 32, a midsection 34 and a lower end section 36. Each of the interlocking legs 14 is pivotally joined to another interlocking leg 14 at the midsection 34 via a first pivot 38. Each of the upper end sections 32 of the interlocking legs 14 is pivotally joined to one of the upper hubs 20 or 22 via a pivot 40. Each of the lower end sections 36 of the interlocking legs 14 is pivotally joined to one of the lower hubs 16 or 18 via a pivot 42 such that the frame 12 is collapsible from an open configuration to a closed configuration and expandable from the closed configuration to the open configuration.

The frame 12 includes a first side 44 and a second side 46. The first and second sides 44 and 46 are the ends of the frame 12 and are opposite to each other and run parallel to each other. Each of the first and second sides 44 and 46 includes one pair of the interlocking legs 14 and at least four hubs, where the four hubs consist of two lower corner hubs 16 and two upper corner hubs 20.

The frame 12 includes a third side 48 and a fourth side 50. Each of the third and fourth sides 48 and 50 are greater in length than any of the first and second sides 44 and 46. Third side 48 is opposite of and parallel to fourth side 50. Each of the third and fourth sides 48 and 50 includes two pairs of the interlocking legs 14 and at least six hubs, where the six hubs consist of two lower corner hubs 16, two upper corner hubs 20, a middle lower hub 18, and a middle upper hub 22.

The interior pair 30 of interlocking legs 14 are spaced from the first and second sides or ends 44 and 46 of the frame 12 and extend to and between the third and fourth sides 48 and 50 of the frame 12. The interior pair 30 of interlocking legs are engaged to four hubs of the third and fourth sides 48 and 50 of the frame 12, namely the middle lower hubs 18 and the upper middle hubs 22. Each of the two additional interlocking legs 14 of the interior pair 30 includes an upper half-section 52 disposed between the upper end section 32 and the midsection 34 of the interlocking leg 14 of the interior pair 30. Each of the upper half-sections 52 is V-shaped or U-shaped such that each upper half-section 52 includes a depression formed therein to make space above the upper half-sections 52 for the flexible bedding 24 to depend freely under a weight of a child from the upper hubs 20 and 22 without making contact with the upper half-sections 52. As shown in FIG. 4A, the V-shape of each of the upper half-sections 52 is formed by a first rectilinear portion and a second rectilinear portion. The first and second rectilinear portions are angularly disposed relative to each other to form the depression. For balance purposes, each of the lower half-sections 54 of the legs 14 of the interior pair 20 is in an inverted V-shape or inverted U-shape to include an inverted depression formed therein.

Figure 4B:
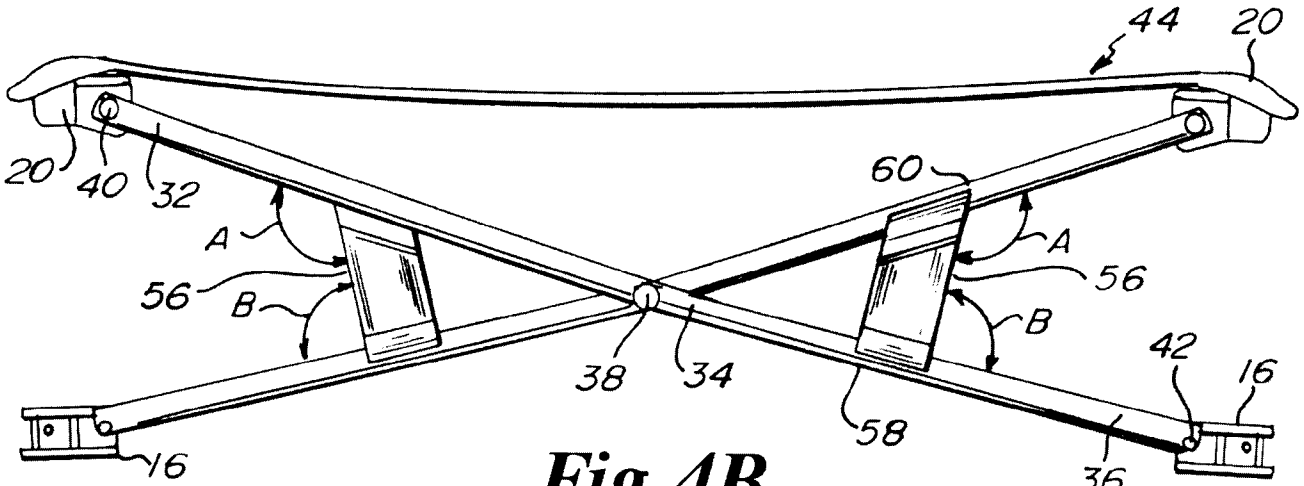
FIG. 4B is an end, somewhat isolated view of one of the end sets of interlocking legs of the portable child bed along lines 4B-4B of FIG. 1 and shows two of the stops of the bed that prevent the frame from further expansion.
Figure 4A:
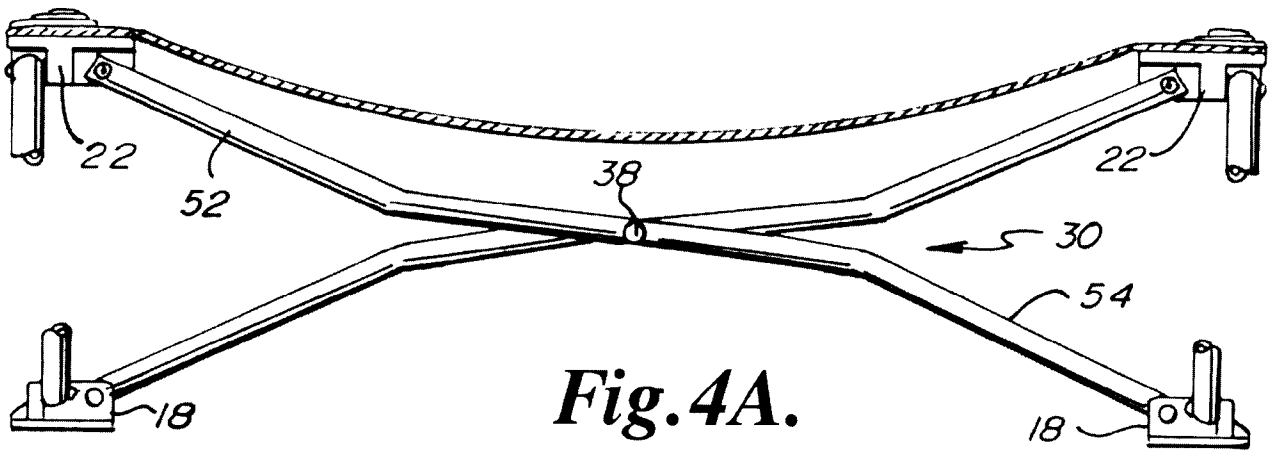
FIG. 4A is a section view of the interior set of interlocking legs of the portable child bed of FIG. 1 along lines 4A-4A of FIG. 1.

Frame 12 includes a pair of stops 56 disposed between interlocking legs 14 of each of the first and second end pairs of interlocking legs 14, as shown in FIGS. 4B and 5D. Stop 56 automatically engages a lower half-section 58 of an interlocking leg 14 of an end pair when the frame 12 is in the open configuration and prevents the frame 12 from further opening. Stop 56 automatically disengages from the lower half-section 58 of the interlocking leg 14 when the frame 12 is collapsed from the open configuration. Stop 56 is rigidly fixed, such as by welding, to an upper half-section 60 of an end pair of interlocking legs 14. The upper half-section 60 is disposed between the upper end section 32 and the midsection 34 of the end pair of interlocking legs 14. The lower half-section 58 is disposed between the midsection 34 and the lower end section 36. The stop 56 extends between one of upper half-sections 60 and one of the lower half-sections 58. Stop 56 includes an axis disposed generally perpendicular to one of the legs, namely, the leg 14 having the lower half-section 58 of the end pair of interlocking legs 14, as shown in FIGS. 4B and 5D by angle B. The axis of stop 56 is disposed obliquely and obtusely relative to the other of the legs of the end pair of interlocking legs 14, namely, the leg 14 having the upper half-section 60, as shown in FIGS. 4B and 5D by angle A. As shown in FIG. 5C, stop 56 includes a cradle 62 for releasably receiving one of the legs of the end pair of interlocking legs 14, namely, the leg 14 having the lower half-section 58. Stop 56 further includes a bend therein such that stop 56 engages half-section 58 directly from above. As with all interlocking legs 14, lower half section 58 (or 54) of one interlocking leg is offset from the upper half section 60 (or 52) of the other interlocking leg. Frame 12 includes at least a first stop 56 disposed on the first side 44 of the frame 12 and preferably includes at least a second stop 56 disposed on the second side 46 of the frame 12. Preferably, frame 12 includes first and second stops 56 on each of the ends 44 and 46 of the frame 12. Where the frame 12 includes two stops 56 on an end of the frame 12, the pivot 38 is disposed between the first and second stops 56, as shown in FIGS. 4B and 5D.

Flexible bedding 24 is engaged to and depends from each of the upper hubs 20 and 22 and is capable of receiving and supporting a small child when the child is sitting or lying down when the frame 12 is in the open configuration. The flexible bedding 12 includes the sheeting 26, and the sheeting 26 extends from the first side or end 44 of the frame 12 to the second side or end 46 of the frame 12 and from the third side 48 of the frame 12 to the fourth side 50 of the frame 12. The flexible bedding 24 includes the flexible straps or strapping 28 engaged to the sheeting 26, such as by stitching or adhesive. The strapping 28 preferably runs underneath the sheeting 26. Strapping 28 runs to and between any two adjacent upper hubs. Flexible strapping 28, such as flexible strap 64, extends obliquely from the third side 48 of the frame 12 to the fourth side 50 of the frame 12 and engages other flexible strapping 28, namely flexible strap 66, that also extends obliquely from the third side 48 of the frame to the fourth side 50 of the frame. Strapping 28, namely flexible strap 68, is spaced from each of the first and second sides 44 and 46 of the frame 12 and extends generally perpendicularly from the third side 48 of the frame 12 to the fourth side 50 of the frame 12. Strapping 28 extends along the third side 48 of the frame 12, namely strap 70 that extends from upper corner hub 20 of one end 44 to the upper corner hub 20 of the other end 46. Strapping 28 extends along the fourth side 50 of the frame 12, namely strap 72 that extends from upper corner hub 20 of one end 44 to the upper corner hub 20 of the other end 46. Strapping 28 further includes end straps 74 and 76 that run along the ends 44 and 46 of the frame 12. Strapping 28 extends along the first side 44 of the frame 12, namely strap 74, and strapping 28 also extends along the third side 48 of the frame 12, namely strap 70, and the straps 70 and 74 engage each other at an upper corner hub 20. Strapping radiates in five directions from the middle upper hubs 22, where strap 70 radiates in two directions and parallel to side 48, where strap 68 radiates perpendicularly to side 48, and where strapping 64 radiates in two directions obliquely relative to side 48.

Strapping 28, wherever located on sheeting 26, engages sheeting 26 such as by stitching or adhesive. Strapping 28, wherever located on sheeting 26, engages other strapping 28 wherever such strapping meets each other.

Strapping 28, along with sheeting 26, engages the upper hubs 20 and 22 via a reinforced opening 78, as shown in FIG. 5B. Reinforced opening 78 includes a grommet 80 that pinches a fabric or leather piece of material 82, strapping 28, and sheeting 26 together. Fabric or leather piece lessens the wear and tear placed on the sheeting 26 by the edges of the grommet 80. The smooth spherical face of a nut 84, which engages a pin connector 86 (shown in FIG. 3) coming up through the hub, pinches down upon the upper face of the grommet 80 and the threaded shaft of the pin connector 86 engages the underlying upper hub 20 or 22 to tie the reinforced opening 78, and thus the flexible bedding 24 tightly to the frame 12. Such a construction is found at each of the upper hubs 20 and 22. Via the pin connector 86 and the nut 84, the flexible bedding 24 is removable from the upper hubs 20 and 22 such that the flexible bedding 24 may be washed.

It should be noted that strapping 28 engages the reinforced opening 78 and also engages all other strapping 28 that arrives at each of the locations of the upper hubs 20 and 22. It should be noted that strapping 28 engages the sheeting 26 along the entire length of the strapping 28 such that strapping 28 engages the sheeting 26 even at the locations of the upper hubs 20 and 22.

When the frame 12 is in the open configuration, the flexible bedding 24 even under the weight of a person is held by the upper hubs 20 and 22 above the legs 14, including the upper half-sections 52 and 60 such that the flexible bedding 24 rides free of the interlocking legs 14 and, at the same time, is engaged directly to the upper hubs 20 and 22.

It should be noted that each of the upper hubs 20 and 22 includes an upper face that is textured or roughened to enhance the engagement of the grommet 80 thereto. Such upper face is relatively wide and extends beyond the square piece 82 in at least the elongate and inner directions to aid in keeping the flexible bedding 24 free of the interlocking legs 24.

The lower hubs 16 and 18 are shown in FIG. 2 as arranged relative to each other in the frame 12, and the upper hubs 20 and 22 are shown in FIG. 3 as arranged relative to each other in the frame 12. It should be noted that each of the interlocking legs 14 of one pair are staggered or offset from each other such that the legs 14 can pivot relative to each other. However, the outside edges 86.1 of adjacent hubs are in line with each other. To provide for such staggering and such an alignment, one of the peripheral legs 14 of one of the hubs is spaced from the edge 86.1 and another of the peripheral legs 14 of the same hub is engaged relatively closely to the edge 86.1. In like fashion, each of the interior legs 14 engaged to middle hubs 18 and 22 is staggered or offset from each other such that the legs 14 can fold in a scissors like fashion, yet interior edges 87 of one middle hub 18 or 22 are aligned with the respective interior edge 87 of the respective middle hub 18 or 22 that is disposed vertically, horizontally or transversely of such hub.

Each of the lower corner hubs 16 is identical to each other. Each of the upper corner hubs 20 is identical to each other. The lower corner hubs 16 are identical to the upper corner hubs 20, except that the upper corner hubs include the pin connector 86, the head of which is shown in FIG. 3 and the shaft of which engages the nut 84 having the smooth spherical broad head that pinches down upon the grommet 80, and except that the roughened or textured surface of one face of the hub is turned up on the upper corner hubs 20 and is turned down on the lower corner hubs 16.

Each of the corner hubs 16 and 20 includes a relatively thin wall 88 spaced from edge 86.1 and a relatively thick wall 90 that forms at least a portion of edge 86.1. It should be noted that the corner hubs 16 and 20 receive the end sections 32 and 36 of the legs within the hubs so as to minimize any pinching of fingers as the frame 12 is folded and unfolded in a scissors like fashion.

Each of the hubs 16, 18, 20 and 22 includes a through hole 92 that remains empty (or may be closed) in the lower hubs 16 and 18 and that receives the shaft of pin connector 86 in the upper hubs 20 and 22. If desired, through hole 92 may cooperate with a slot or key that may receive a flange formed in the nut 84 such that nut 84 is prevented from spinning in hole 92.

Each of the lower middle hubs 18 is identical to each other. Each of the upper middle hubs 22 is identical to each other. The lower middle hubs 18 are identical to the upper middle hubs 22, except that the upper middle hubs include the pin connector 86, the head of which is shown in FIG. 3 and the shaft of which engages the nut 84 having the smooth spherical broad head that pinches down upon the grommet 80, and except that the roughened or textured surface of one face of the hub is turned up on the upper middle hubs 22 and is turned down on the lower middle hubs 18.

Each of the middle hubs 18 and 22 includes three walls for engaging the legs 14. Walls 94 and 96 are slightly offset from each other and extend peripherally to engage the peripheral legs 14. Wall 98 extends perpendicularly to walls 94 and 96 and inwardly to engage interior legs 14 of pair 30. It should be noted that the middle hubs 18 and 22 receive the end sections 32 and 36 of the legs 14 within the hubs so as to minimize any pinching of fingers as the frame 12 is folded and unfolded in a scissors like fashion.

The bed 10 is preferably less than about 12 inches in height, more preferably less than about 11 inches in height, yet more preferably less than about 10 inches in height, still more preferably less than about nine inches in height, and most preferably stands about eight inches in height. The bed 10 is preferably greater than about one inch in height.

The bed 10 is preferably between about 24 inches and about 100 inches in length, more preferably between about 24 inches and about 75 inches in length, and most preferably between about 24 inches and about 50 inches in length.

The bed is preferably between about 20 inches and about 30 inches in width, and more preferably between about 20 and 26 inches in width.

When the bed 10 is being opened, the bed 10 as a whole may open just short of where the cradle 62 of the stop 56 can engage the lower half-section 58. This type of construction to the bed 10 distributes the load of a child over the bed 10 as a whole instead of relying on merely the interplay between the four stops 56 and the half-sections 58. This type of construction distributes the load to the flexible bedding 24, including the sheeting 26 and the strapping 28 and to the legs 14 not engaged by the four stops 56. However, when a relatively heavy child, adult, or rather large dog sits or lies down on the bed 10, then the stops 56 will engage the underlying half-sections 58.

The legs 14 are preferably formed of a metal material such as aluminum or steel. Sheeting 26 is preferably a fabric material such as a canvas or nylon. Strapping 28 is preferably a heavy duty nylon but may be a canvas material if desired.

In operation, the portable child bed 10 is taken out of a storage bag in its closed configuration, as shown in FIG. 5A. Then, via manipulating any part or parts of the portable child bed 10 since all such parts are interconnected, the frame 12 is expanded to the open configuration shown in FIG. 1. Such part or parts include the lower hubs 16 and 18, the upper hubs 20 and 22, the legs 14, and/or the flexible bedding 24. As indicated above, as the open configuration is reached, depending upon the weight placed upon the flexible bedding 24, the cradles 62 of the stops 56 may or may not engage the lower half-sections 58 of the legs 14. When in the open configuration as shown in FIG. 1, a bed sheet such as a fitted bed sheet, may be placed about and on the flexible bedding 24. A child or other person may then lie or sit down on the portable child bed 10. When lying down, the portable child bed 10 offers a comfortable bed, without the protrusion into the body of any part or parts of the legs 14, including the upper half-sections 52. When lying down or sitting upon the portable child bed 10, the bed 10 is resistant to tipping because of the interconnected legs and because of its relative low height. To fold the bed from the open configuration as shown in FIG. 1 to the closed configuration of FIG. 5A, any part or parts of the bed 10 may be manipulated, including the lower hubs 16 and 18, the upper hubs 20 and 22, the legs 14, and/or the flexible bedding 24.

The bed 10 is not intended to be a step stool or chair. However, the bed 10 is of sufficient strength, including the frame 12 and flexible bedding 24, such that the bed 10 will retain its integrity even if an adult steps on any portion of the flexible bedding 24 with one or two feet at the same time and brings to bear his entire weight on the flexible bedding with said one or two feet, where the adult weighs about 165 pounds and wears American size 9 shoes.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A portable child bed comprising:

a) a frame collapsible from an open configuration to a closed configuration and expandable from said closed configuration to said open configuration, with said frame comprising:

i) at least six upper hubs and at least six lower hubs, with said upper hubs lying generally in a first plane in each of the open and closed configurations, and with said lower hubs lying generally in a second plane in each of the open and closed configurations, with said upper hubs confronting each other when the portable child bed is in the closed configuration, with said lower hubs confronting each other when the portable child bed is in the closed configuration, with each of the upper hubs being paired with one of the lower hubs when the portable child bed is in the open configuration, with each of said lower hubs having a face for confronting a surface on which the portable child bed rests;

ii) at least twelve interlocking legs, with each of the interlocking legs having an upper end section, a midsection and a lower end section, with each of the interlocking legs being pivotally joined to another interlocking leg at said midsection via a pivot thereby forming pairs of interlocking legs, with each of the upper end sections of said interlocking legs being pivotally joined to one of said upper hubs, and with each of the lower end sections of said interlocking legs being pivotally joined to one of said lower hubs such that the frame is collapsible from said open configuration to said closed configuration and expandable from said closed configuration to said open configuration, with each of said at least twelve interlocking legs including an upper-half section disposed between said upper end section and said midsection, and with each of said at least twelve interlocking legs including a lower half-section disposed between said lower end section and said midsection;

iii) with said frame including first and second sides, with said first and second sides being opposite to each other, with said frame including third and fourth sides, with said third and fourth sides being opposite to each other, with said third and fourth sides being greater in length than the first and second sides, with each of the first and second sides of the frame including a pair of said interlocking legs, with each of the third and fourth sides including two pairs of said interlocking legs;

iv) with said first side including first and second upper hubs and first and second lower hubs, with said second side including first and second upper hubs and first and second lower hubs, with said third side including said first upper hub and said first lower hub of said first side, with said third side including said first upper hub and said first lower hub of said second side, and with said third side including an additional upper hub and an additional lower hub, with said fourth side including said second upper hub and said second lower hub of said first side, with said fourth side including said second upper hub and said second lower hub of said second side, with said fourth side including an additional upper hub and an additional lower hub;

v) with said frame including a first stop disposed between interlocking legs of a first pair of said interlocking legs, with said first stop automatically engaging one interlocking leg of said first pair of interlocking legs when said frame is in said open configuration and preventing said frame from further opening, and with said first stop automatically disengaging said one interlocking leg of said first pair of interlocking legs when said frame is collapsed from said open configuration, and with said first stop disposed and extending between one of said upper half-sections and one of said lower half-sections of said first pair of interlocking legs;

vi) with said frame including two additional interlocking legs, with said two additional interlocking legs being paired with each other, with said two additional interlocking legs being spaced from the first and second sides of the frame, with said two additional interlocking legs extending to and between the third and fourth sides of the frame, and with said two additional interlocking legs being engaged to said additional upper and said additional lower hubs of the third and fourth sides of the frame, with each of said two additional interlocking legs including an upper half-section disposed between an upper end section and a midsection of each of said additional interlocking leg;

b) flexible bedding engaged to each of the upper hubs and capable of receiving and supporting a small child lying down when said frame is in the open configuration, with said flexible bedding folding closed when the frame is collapsed from said open configuration to said closed configuration, and with said flexible bedding folding open when the frame is expanded from said closed configuration to said open configuration;

c) wherein said flexible bedding comprises sheeting extending from the first side of the frame to the second side of the frame and from the third side of the frame to the fourth side of the frame, and wherein said flexible bedding further comprises a flexible strapping arrangement engaged by stitching to said sheeting and running underneath said sheeting, with said flexible strapping arrangement running between at least two upper hubs;

d) wherein said flexible strapping arrangement comprises a first flexible strap extending obliquely from an upper hub on the third side of the frame to an upper hub on the fourth side of the frame and engages a second flexible strap that also extends obliquely from an upper hub on the third side of the frame to an upper hub on the fourth side of the frame;

e) wherein said flexible strapping arrangement comprises a third flexible strap extending along the third side of the frame from an upper hub to an upper hub and a fourth flexible strap extending along the fourth side of the frame from an upper hub to an upper hub;

f) wherein said flexible strapping arrangement comprises a fifth flexible strap extending along the first side of the frame from an upper hub to an upper hub and a sixth flexible strap extending along the second side of the frame from an upper hub to an upper hub, with said fifth flexible strap that extends along the first side of the frame engaging said third and fourth flexible straps at upper hubs, and with said sixth flexible strap that extends along the second side of the frame engaging said third and fourth flexible straps at upper hubs; and g) with each of said upper half-sections of said additional interlocking legs having a depression formed therein to make space above said upper half-sections of said additional interlocking legs for said flexible bedding to depend freely under a weight of a child from said upper hubs without making contact with said upper half-sections of said additional interlocking legs, with each of said upper half-sections of said additional interlocking legs including a first rectilinear portion and a second rectilinear portion, and with each of said upper half-sections of said additional interlocking legs forming a U-shape and forming said depression.

2. The portable child bed of claim 1, wherein said first stop includes an axis disposed obliquely to one of the legs of said first pair of interlocking legs.

3. The portable child bed of claim 1, wherein said first stop includes a cradle for releasably receiving said one interlocking leg of said first pair of interlocking legs.

4. The portable child bed of claim 1, and further comprising a second stop, with said first stop being disposed on said first side of the frame, and with said second stop being disposed on said second side of the frame.

5. The portable child bed of claim 1, and further comprising a second stop, with said second stop extending between one of said upper half-sections and one of said lower half-sections of said first pair of interlocking legs, and with the pivot of said first pair of interlocking legs being between said first and second stops.

6. The portable child bed of claim 1, wherein said first stop includes a bend therein such that one of said lower half-sections of said first pair of interlocking legs is engaged directly from above.

7. A portable child bed comprising:

a) a frame collapsible from an open configuration to a closed configuration and expandable from said closed configuration to said open configuration, with said frame comprising:

i) at least six upper hubs and at least six lower hubs, with said upper hubs lying generally in a first plane in each of the open and closed configurations, and with said lower hubs lying generally in a second plane in each of the open and closed configurations, with said upper hubs confronting each other when the portable child bed is in the closed configuration, with said lower hubs confronting each other when the portable child bed is in the closed configuration, with each of the upper hubs being paired with one of the lower hubs when the portable child bed is in the open configuration, with each of said lower hubs having a face for confronting a surface on which the portable child bed rests;

ii) at least twelve interlocking legs, with each of the interlocking legs having an upper end section, a midsection and a lower end section, with each of the interlocking legs being pivotally joined to another interlocking leg at said midsection via a pivot thereby forming pairs of interlocking legs, with each of the upper end sections of said interlocking legs being pivotally joined to one of said upper hubs, and with each of the lower end sections of said interlocking legs being pivotally joined to one of said lower hubs such that the frame is collapsible from said open configuration to said closed configuration and expandable from said closed configuration to said open configuration, with each of said at least twelve interlocking legs including an upper-half section disposed between said upper end section and said midsection, and with each of said at least twelve interlocking legs including a lower half-section disposed between said lower end section and said midsection;

iii) with said frame including first and second sides, with said first and second sides being opposite to each other, with said frame including third and fourth sides, with said third and fourth sides being opposite to each other, with said third and fourth sides being greater in length than the first and second sides, with each of the first and second sides of the frame including a pair of said interlocking legs, with each of the third and fourth sides including two pairs of said interlocking legs;

iv) with said first side including first and second upper hubs and first and second lower hubs, with said second side including first and second upper hubs and first and second lower hubs, with said third side including said first upper hub and said first lower hub of said first side, with said third side including said first upper hub and said first lower hub of said second side, and with said third side including an additional upper hub and an additional lower hub, with said fourth side including said second upper hub and said second lower hub of said first side, with said fourth side including said second upper hub and said second lower hub of said second side, with said fourth side including an additional upper hub and an additional lower hub;

v) with said frame including a first stop disposed between interlocking legs of a first pair of said interlocking legs, with said first stop automatically engaging one interlocking leg of said first pair of interlocking legs when said frame is in said open configuration and preventing said frame from further opening, and with said first stop automatically disengaging said one interlocking leg of said first pair of interlocking legs when said frame is collapsed from said open configuration, with said first stop disposed and extending between one of said upper half-sections and one of said lower half-sections of said first pair of interlocking legs, with said first stop including a cradle for releasably receiving one of the legs of said first pair of interlocking legs, with said first stop being disposed on said first side of the frame, and further comprising a second stop, with said second stop being disposed on said second side of the frame;

vi) with said frame including two additional interlocking legs, with said two additional interlocking legs being paired with each other, with said two additional interlocking legs being spaced from the first and second sides of the frame, with said two additional interlocking legs extending to and between the third and fourth sides of the frame, and with said two additional interlocking legs being engaged to said additional upper and said additional lower hubs of the third and fourth sides of the frame, with each of said two additional interlocking legs including an upper half-section disposed between an upper end section and a midsection of each of said additional interlocking leg;

b) flexible bedding engaged to each of the upper hubs and capable of receiving and supporting a small child lying down when said frame is in the open configuration, with said flexible bedding folding closed when the frame is collapsed from said open configuration to said closed configuration, and with said flexible bedding folding open when the frame is expanded from said closed configuration to said open configuration;

c) wherein said flexible bedding comprises sheeting extending from the first side of the frame to the second side of the frame and from the third side of the frame to the fourth side of the frame, and wherein said flexible bedding further comprises a flexible strapping arrangement engaged by stitching to said sheeting and running underneath said sheeting, with said flexible strapping arrangement running between at least two upper hubs;

d) wherein said flexible strapping arrangement comprises a first flexible strap extending obliquely from an upper hub on the third side of the frame to an upper hub on the fourth side of the frame and engages a second flexible strap that also extends obliquely from an upper hub on the third side of the frame to an upper hub on the fourth side of the frame;

e) wherein said flexible strapping arrangement comprises a third flexible strap extending along the third side of the frame from an upper hub to an upper hub and a fourth flexible strap extending along the fourth side of the frame from an upper hub to an upper hub;

f) wherein said flexible strapping arrangement comprises a fifth flexible strap extending along the first side of the frame from an upper hub to an upper hub and a sixth flexible strap extending along the second side of the frame from an upper hub to an upper hub, with said fifth flexible strap that extends along the first side of the frame engaging said third and fourth flexible straps at upper hubs, and with said sixth flexible strap that extends along the second side of the frame engaging said third and fourth flexible straps at upper hubs; and g) with each of said upper half-sections of said additional interlocking legs having a depression formed therein to make space above said upper half-sections of said additional interlocking legs for said flexible bedding to depend freely under a weight of a child from said upper hubs without making contact with said upper half-sections of said additional interlocking legs, with each of said upper half-sections of said additional interlocking legs including a first rectilinear portion and a second rectilinear portion, and with each of said upper half-sections of said additional interlocking legs forming a U-shape and forming said depression.

* * * * *